US010292500B2

(12) United States Patent
Rogers, Jr.

(10) Patent No.: US 10,292,500 B2
(45) Date of Patent: May 21, 2019

(54) QUICK-EXIT ASSEMBLY FOR RECLINING FURNITURE

(71) Applicant: L&P PROPERTY MANAGEMENT COMPANY, South Gate, CA (US)

(72) Inventor: Walter Clark Rogers, Jr., Denton, NC (US)

(73) Assignee: L&P property management company, South Gate, CA (US)

( * ) Notice: Subject to any disclaimer, the term of this patent is extended or adjusted under 35 U.S.C. 154(b) by 476 days.

(21) Appl. No.: 15/135,153

(22) Filed: Apr. 21, 2016

(65) Prior Publication Data

US 2017/0303692 A1 Oct. 26, 2017

(51) Int. Cl.
*A47C 7/00* (2006.01)
*A47C 7/50* (2006.01)
*A47C 1/034* (2006.01)

(52) U.S. Cl.
CPC ..... *A47C 7/506* (2013.01); *A47C 1/034* (2013.01)

(58) Field of Classification Search
CPC ..... A47C 7/506; A47C 1/034
See application file for complete search history.

(56) References Cited

U.S. PATENT DOCUMENTS 1,614,038 A * 1/1927 Maxson ..... E21B 19/081 173/145
2,755,681 A * 7/1956 Merriman ..... B25B 5/101 269/212
3,608,612 A * 9/1971 Pemberton ..... E05F 15/673 160/188
3,704,014 A * 11/1972 Keene ..... B25B 5/101 269/172
4,299,377 A * 11/1981 Lenz ..... B25B 1/106 269/136
4,513,955 A * 4/1985 Daubon ..... B23K 37/0435 269/155
4,687,252 A 8/1987 Bell et al.
4,759,587 A 7/1988 Bucka
4,802,374 A * 2/1989 Hamelin ..... B60N 2/0232 248/429

(Continued)

FOREIGN PATENT DOCUMENTS

DE 202015105637 U1 12/2015
WO 2007006313 A1 1/2007
WO 2016026495 A2 2/2016

OTHER PUBLICATIONS

International Search Report and Written Opinion dated Jun. 16, 2017 in International Application No. PCT/US17/23294, 12 pages.

*Primary Examiner* — David M Fenstermacher
(74) *Attorney, Agent, or Firm* — Shook, Hardy & Bacon L.L.P.

(57) ABSTRACT

A quick-exit assembly for reclining furniture, including motorized versions, is provided. An exemplary quick-exit assembly may include a linkage assembly configured to move between a first position and a second position. A drive mechanism may be coupled to the linkage assembly, and may be configured to move the linkage assembly between the first position and the second position using an actuator, and also, allow movement of the linkage assembly between the first position and the second position using manual force with reduced restriction from the drive mechanism.

18 Claims, 8 Drawing Sheets

(56) References Cited

U.S. PATENT DOCUMENTS

| | | | | |
|---|---|---|---|---|
| 5,222,402 | A * | 6/1993 | White | B60N 2/067 248/429 |
| 5,259,257 | A * | 11/1993 | Mouri | B60N 2/0232 248/429 |
| 5,483,853 | A | 1/1996 | Moradell et al. | |
| 5,556,165 | A * | 9/1996 | Pickles | B60N 2/233 297/362.14 |
| 5,568,704 | A * | 10/1996 | Williams | F16D 1/02 49/362 |
| 6,623,077 | B1 | 9/2003 | Piaulet et al. | |
| 6,739,650 | B2 | 5/2004 | Bartlett | |
| 8,171,823 | B2 * | 5/2012 | Koga | B60N 2/0232 74/425 |
| 8,967,011 | B2 * | 3/2015 | Lee | B60R 11/02 74/425 |
| 2008/0163708 | A1 * | 7/2008 | Porinsky | B60N 2/067 74/89.14 |
| 2008/0257087 | A1 * | 10/2008 | Chen | F16H 25/2015 74/425 |
| 2009/0050451 | A1 | 2/2009 | Sorensen et al. | |
| 2013/0190604 | A1 * | 7/2013 | Moffatt | A61B 5/0555 600/411 |
| 2014/0312725 | A1 | 10/2014 | Oberndorfer | |
| 2015/0135865 | A1 | 5/2015 | Oberndorfer | |

* cited by examiner

QUICK-EXIT ASSEMBLY FOR RECLINING FURNITURE

FIELD

The present technology relates to reclining furniture, including motorized versions.

BRIEF SUMMARY

A high level overview of various aspects of the present technology is provided in this section to introduce a selection of concepts that are further described below in the detailed description section of this disclosure. This summary is not intended to identify key or essential features of the claimed subject matter, nor is it intended to be used as an aid in isolation to determine the scope of the claimed subject matter.

In brief, and at a high level, this disclosure describes, among other things, quick-exit assemblies for reclining furniture that allow movement of the reclining furniture from a first position (e.g., a reclined position) to a second position (e.g., a more upright position) under motorized power from a drive mechanism, and also, under manual force with reduced restriction from the drive mechanism to a retracted position, to allow greater control in adjusting the reclining furniture.

In one embodiment of the technology, a quick-exit assembly for reclining furniture is provided. The assembly comprises a linkage assembly and a drive mechanism comprising at least one actuator. The drive mechanism is coupled to the linkage assembly and configured to move the linkage assembly from an extended first position to a retracted second position using the at least one actuator, and also allow movement of the linkage assembly from the first position to the second position manually with reduced restriction from the drive mechanism.

In another embodiment of the technology, a quick-exit assembly for reclining furniture is provided. The assembly comprises a linkage assembly and a drive mechanism coupled to the linkage assembly. The drive mechanism comprises at least one actuator, a shaft having a first set of teeth, the shaft rotatably coupled to the at least one actuator, a block coupled to the shaft and to the linkage assembly, the block comprising a first gear having a second set of teeth that engage with the first set of teeth, and a first one-way bearing that couples the first gear to the block.

In another embodiment of the technology, a quick-exit assembly for reclining furniture is provided. The assembly comprises a linkage assembly and a drive mechanism. The drive mechanism comprises an actuator, a shaft rotatably coupled to the actuator, the shaft comprising a first set of teeth, a block coupled to the linkage assembly, and a first engagement link movably coupled to the block and comprising a second set of teeth configured to engage with the first set of teeth.

As used in this disclosure, "reclining furniture" may encompass any type of furniture, such as bedding, seating, chairs, recliners, and the like, which are configured to move between different positions (e.g., upright, partially reclined, and/or fully reclined).

This disclosure discusses quick-exit assemblies for reclining furniture that allow accelerated or manually adjustable closure (e.g., reclined position to upright position), but the assemblies, mechanisms, and components herein may be used for both opening and/or closing of reclining furniture.

BRIEF DESCRIPTION OF THE DRAWINGS

The present invention is described in detail below with reference to the attached drawing figures, which are intended to be exemplary and non-limiting in nature, wherein.

DETAILED DESCRIPTION

The subject matter of the present technology is described with specificity in this disclosure to meet statutory requirements. However, the description is not intended to limit the scope of the technology. Rather, the claimed subject matter may be embodied in other ways to include different features, components, steps, and/or combinations of steps, similar to the ones described in this disclosure, and in conjunction with other present and future technologies. The terms "step" and "block" should not be interpreted as implying any particular order among or between steps or blocks unless and except when the order of individual steps or blocks is explicitly described and required.

At a high level, the present technology relates generally to reclining furniture, including motorized versions. More specifically, the present technology provides for quick-exit assemblies that may be incorporated into reclining furniture to allow motorized movement of the reclining furniture using a drive mechanism, and/or manual movement of the reclining furniture with reduced restriction by the drive mechanism, to allow a more accelerated or customized movement of the reclining furniture when desired. Exemplary components, systems, and assemblies of the technology are described below with respect to FIGS. 1-7.

Figure 1A:
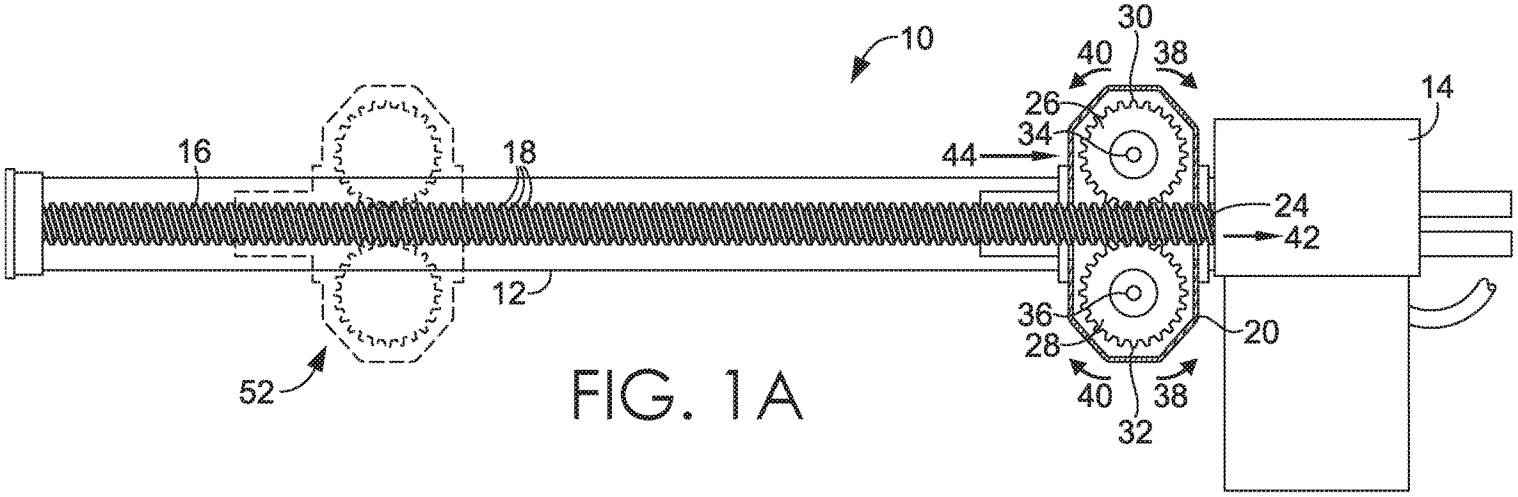
FIG. 1A is a top elevation view of an exemplary drive mechanism for a quick-exit assembly, in accordance with an embodiment of the present technology.

Referring to FIG. 1A, a top elevation view of an exemplary drive mechanism 10 for a quick-exit assembly for reclining furniture is provided, in accordance with an embodiment of the present technology. In FIG. 1A, the drive mechanism 10 includes an actuator 14 and a shaft 16. The shaft 16 is rotatably coupled to the actuator 14 and comprises a first set of teeth or threads 18. The drive mechanism 10 further includes a block 20 that is movably coupled to the shaft 16 and coupled to a track 12 extending from the actuator 14. The actuator 14 is configured to rotate the shaft 16 (e.g., providing a worm drive). The block 20 may be coupled to a linkage assembly so that when the block 20 moves, the linkage assembly can be adjusted as well.

The block 20 further includes a first gear 26 and a second gear 28 which are each rotatably coupled within the block 20. The first and second gears 26, 28 are positioned such that they are on opposite sides of the shaft 16. The first gear 26 is coupled to the block 20 with a first one-way bearing 34 mounted at the center of the first gear 26. The second gear 28 is coupled to the block with a second one-way bearing 36 mounted at the center of the second gear 28. The first gear 26 includes a second set of teeth 30 that engage with the first set of teeth 18 on the shaft 16, and the second gear 28 includes a third set of teeth 32 that engage with the first set of teeth 18 on the shaft 16.

The first and second one-way bearings 34, 36 each allow rotation of the respective first and second gears 26, 28 in a first direction 38, while also reducing, restricting, and/or preventing rotation of the respective first and second gears 26, 28 in an opposite second direction 40. Accordingly, when the shaft 16 is rotated by the actuator 14, a force 42 is applied to the second and third sets of teeth 30, 32 of the respective first and second gears 26, 28 by the first set of teeth 18. The force 42 applied to the gears 26, 28 is resisted by the first and second one-way bearings 34, 36, which restrict movement of the gears 26, 28 in the second direction 40. To state it differently, the force 42 is applied by the first set of teeth 18 to the gears 26, 28, but the one way bearings 34, 36 restrict or prevent the gears 26, 28 from turning, and as a result, the block 20 can move relative to the shaft 16.

To describe an exemplary operation, the shaft 16 may be rotated by the actuator 14 to transfer the force 42 to the gears 26, 28 to move the block 20 from an extended position 52 to the retracted position 24 (the block 20 is shown in phantom lines at the extended position 52 for exemplary purposes). If accelerated, or rather, manually controlled movement is desired, a force 44 can be applied to the block 20 (e.g., from leaning against an associated linkage assembly or pulling a lever) to move the block 20 back along the shaft 16 by rolling the gears 26, 28 across the shaft 16 in the first direction 38. In this circumstance, the manual override does not require the actuator 14 to spin simultaneously to allow the block 20 to move, which reduces restriction on the movement of the block 20.

Figure 1B:
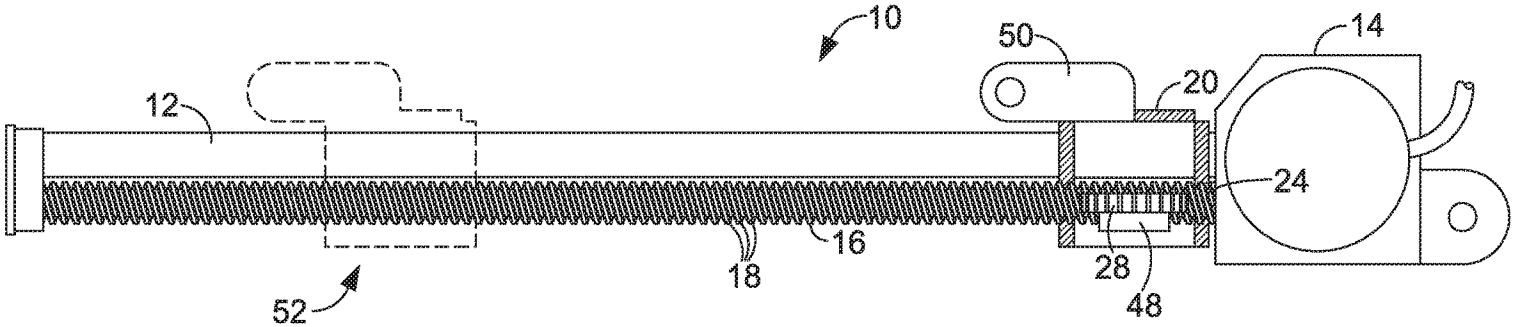
FIG. 1B is a side elevation view of the exemplary drive mechanism shown in FIG. 1A, in accordance with an embodiment of the present technology.

Referring to FIG. 1B, a side elevation view of the drive mechanism 10 shown in FIG. 1A is provided, in accordance with an embodiment of the present technology. In FIG. 1B, many of the components shown in FIG. 1A are again provided. Additionally, a mount 48 is shown, the mount 48 being coupled to the block 20 and extending beneath each of the gears 26, 28 to provide support. Further, a bracket 50 is coupled to the block 20. The bracket 50 provides a mounting point for coupling the block 20 to a linkage assembly of a reclining furniture item. Once again, the block 20 can be moved from the extended position 52 (which may be any distance from the retracted position 24 and is merely shown at one exemplary distance in FIGS. 1A and 1B) to the retracted position 24 using the actuator 14 and resistance from the one-way bearings 34, 36, or by manual force rolling the gears 26, 28 along the shaft 16.

Figure 2B:
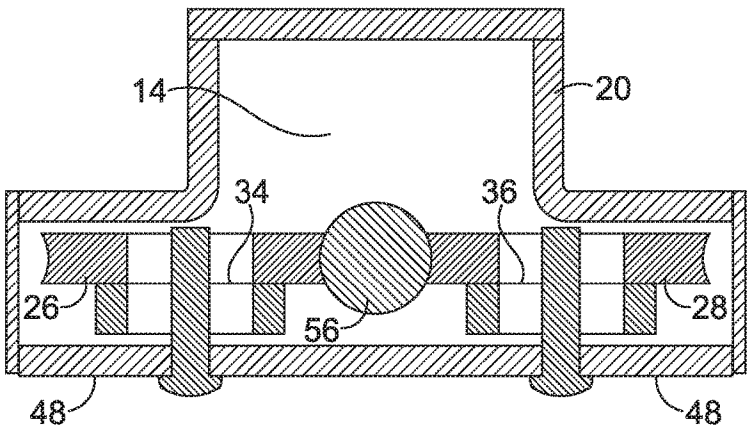
FIG. 2B is an enlarged, front elevation, cross-section view of the drive mechanism shown in FIG. 2A taken along cut-line 2B, in accordance with an embodiment of the present technology.
Figure 2A:
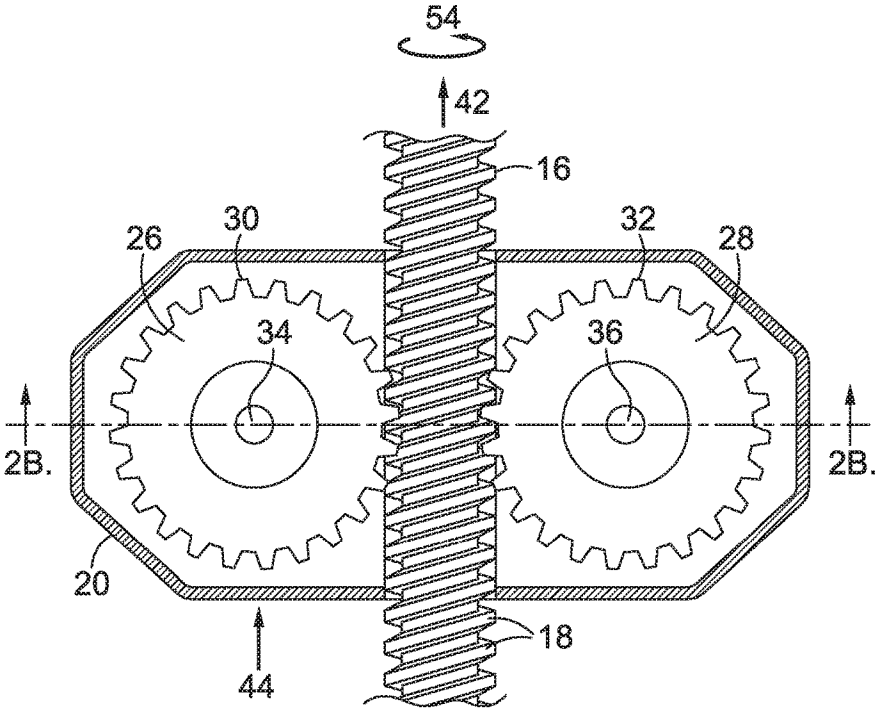
FIG. 2A is a partial, enlarged, top elevation, cross-section view of the drive mechanism shown in FIGS. 1A-1B, in accordance with an embodiment of the present technology.

Referring to FIG. 2A, an enlarged, top elevation, cross-section view of the drive mechanism 10 shown in FIGS. 1A-1B is provided, in accordance with an embodiment of the present technology. In FIG. 2A, the gears 26, 28 are shown engaged with the shaft 16. More specifically, the second set of teeth 30 of the first gear 26 and the third set of teeth 32 of the second gear 28 are in contact with the first set of teeth 18. Accordingly, rotation of the shaft 16 in a first direction 54 provides the force 42 to the first and second gears 26, 28, which is resisted by the respective one-way bearings 34, 36, to allow movement of the block 20 under motorized power. Additionally, a force 44 may be applied separately to the block 20 to roll the gears 26, 28 across the shaft 16, to allow accelerated or manually controlled closure.

Referring to FIG. 2B, an enlarged, front elevation, cross-section view of the drive mechanism 10 shown in FIG. 2A taken along cut-line 2B is provided, in accordance with an embodiment of the present technology. In addition to the components described in relation to FIG. 2A, an opening 56 is provided between the gears 26, 28 for the shaft 16 to be received and coupled to the actuator 14.

Figure 3A:
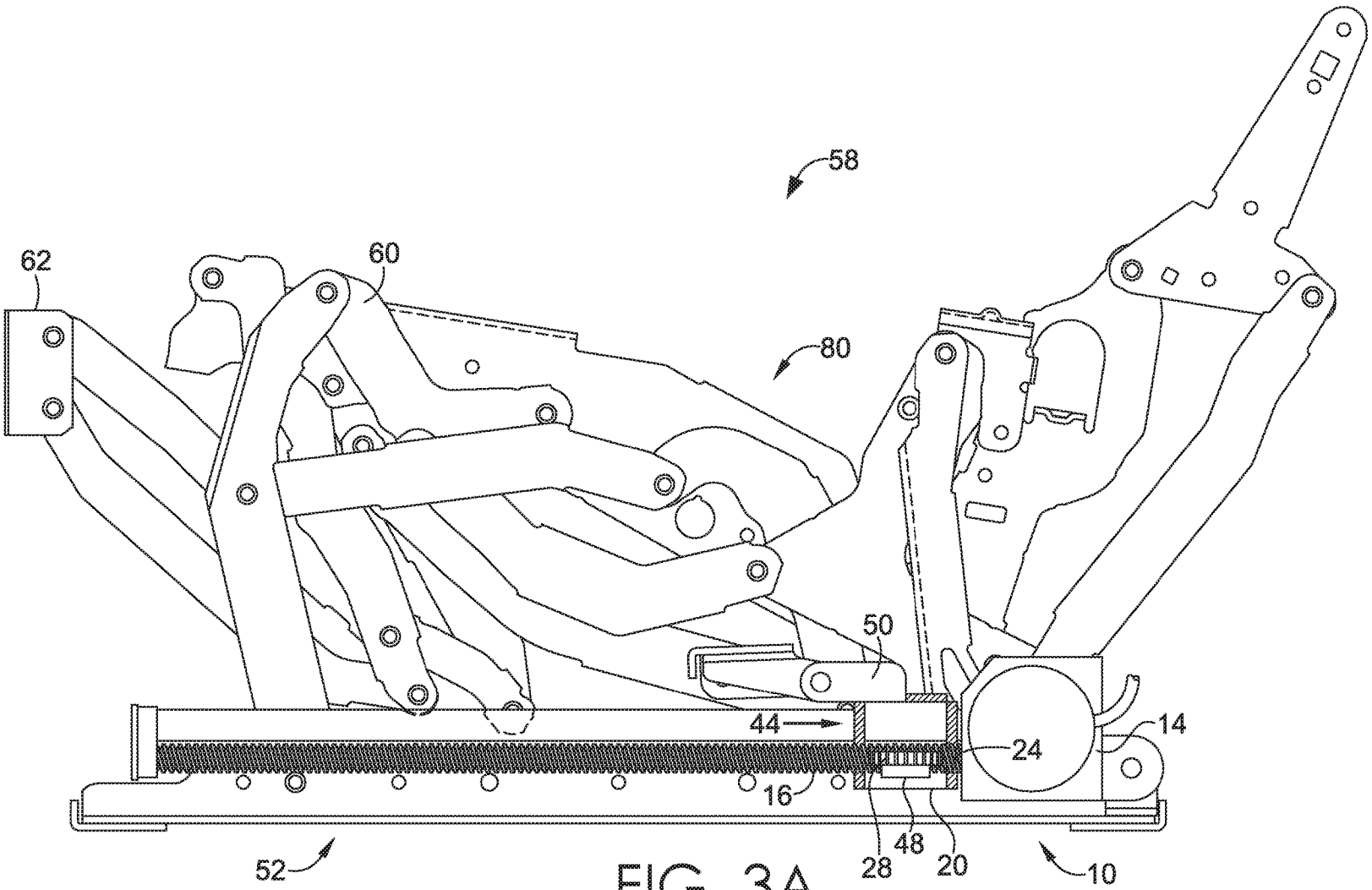
FIG. 3A is a side elevation view of a first exemplary quick-exit assembly for reclining furniture, in accordance with an embodiment of the present technology.

Referring to FIG. 3A, a side elevation view of a first exemplary quick-exit assembly 58 for reclining furniture is provided, in accordance with an embodiment of the present technology. In FIG. 3A, the quick-exit assembly 58 comprises a linkage assembly 60 and a drive mechanism 10 of the type described in relation to FIGS. 1A-1B and 2A-2B. The linkage assembly 60 is comprised of a plurality of rotatably coupled linkages. Further, the drive mechanism 10 includes the block 20 which is coupled to the shaft 16 using the gears 26, 28 (gear 28 is obscured in FIG. 3A), the gears 26, 28 being coupled to the block 20 using one way bearings 34, 36, as discussed with respect to FIGS. 1A and 2A. The bracket 50 is coupled to the linkage assembly 60, such that when the block 20 is moved between a retracted position 24 and an extended position 52, the linkage assembly 60 is moved as well.

Figure 3B:
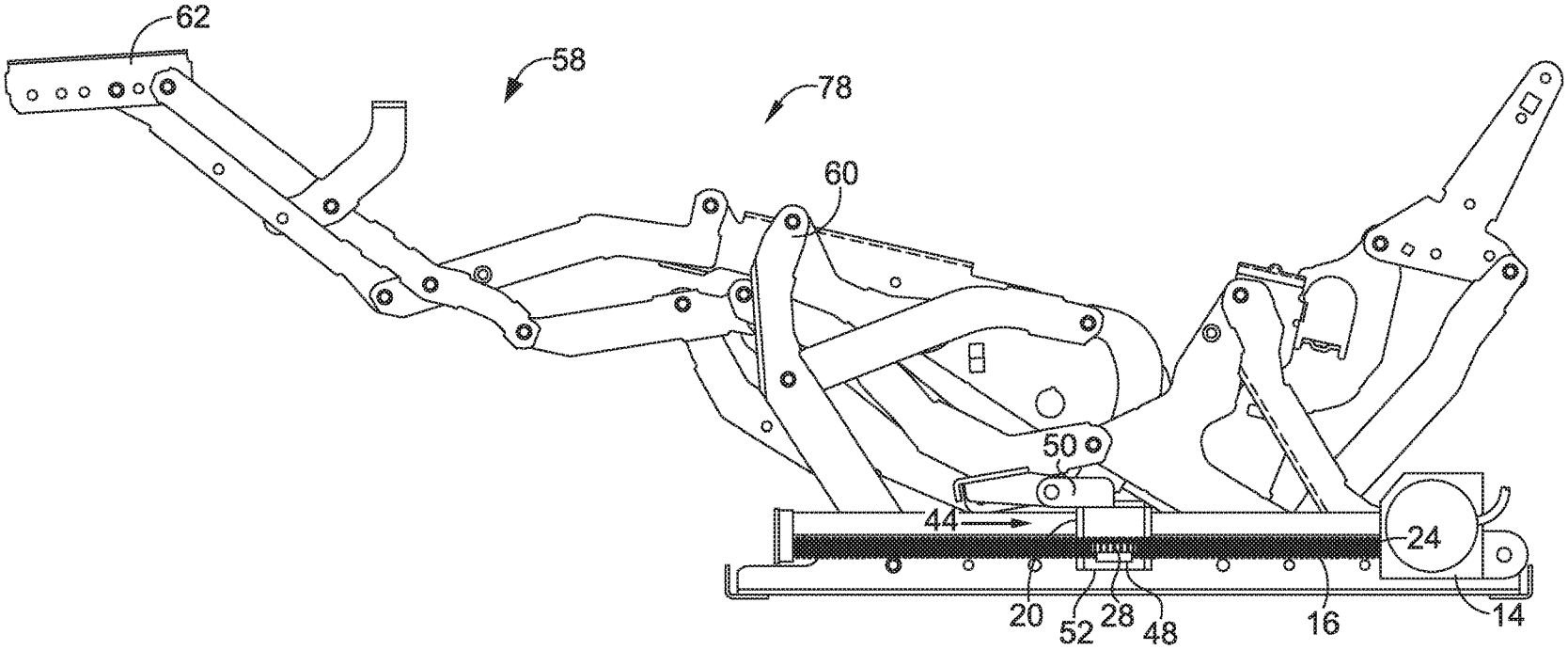
FIG. 3B is another side elevation view of the exemplary quick-exit assembly shown in FIG. 3A in a more reclined position, in accordance with an embodiment of the present technology.

Referring to FIG. 3B, another side elevation view of the exemplary quick-exit assembly 58 shown in FIG. 3A is provided, in accordance with an embodiment of the present technology. In FIG. 3B, the linkage assembly 60 is extended to a more reclined position. The configuration shown in FIG. 3B may be considered a first position 78 of the linkage assembly, where the block 20 is in an extended position 52 and an ottoman portion 62 is extended, and the configuration shown in FIG. 3A may be considered a second position 80 of the linkage assembly 60, where the block 20 is in the retracted position 24 and the ottoman portion 62 is retracted. In other words, the first position 78 may be a more reclined position and the second position 80 may be a more upright position, relatively speaking. It should be noted that exact positions, distances, and angular differences may not be required, and rather, the first position 78 and the second position 80 may be considered as relative terms.

As discussed with respect to FIGS. 1A-1B and 2A-2B, when the block 20 is in the extended position 52, and correspondingly, the linkage assembly 60 is in the first position 78, the actuator 14 may be used to rotate the shaft 16, to engage the first set of teeth 18 of the shaft 16 with the second and third sets of teeth 30, 32 of the gears 26, 28 to move the block 20 towards the retracted position 24 to close the assembly 58. When a user wishes to accelerate or manually influence the closure of the assembly 58, the user may apply the force 44 to the block 20 (e.g., by leaning on the linkage assembly 60 such as with a downward force on the ottoman portion 62) to move the block 20 towards the retracted position 24 by rolling the gears 26, 28 across the shaft 16.

Figure 4:
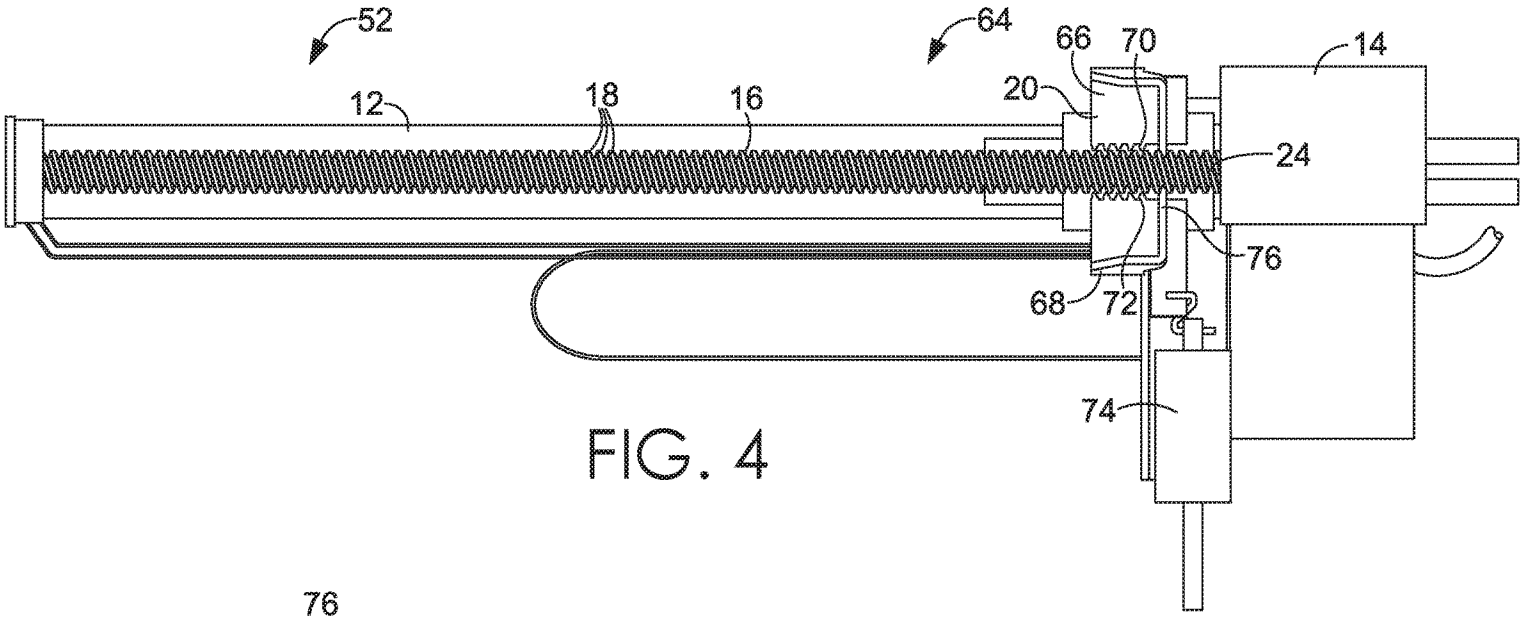
FIG. 4 is a top elevation view of an exemplary drive mechanism for a quick-exit assembly, in accordance with an embodiment of the present technology.

Referring to FIG. 4, an exemplary drive mechanism 64 for a quick-exit assembly for reclining furniture is provided, in accordance with an embodiment of the present technology. In FIG. 4, the drive mechanism 64 includes the actuator 14, the shaft 16 including the first set of teeth 18, and the block 20 which is movably coupled to the drive mechanism 64. The block 20 further includes a first engagement link 66 and a second engagement link 68 which are movably coupled to the block 20, and/or otherwise movably coupled to the drive mechanism 64. The first engagement link 66 comprises a second set of the teeth 70 configured to engage with the first set of teeth 18, and the second engagement link 68 comprises a third set of teeth 72 configured to engage with the first set of teeth 18. The engagement links 66, 68 are movable relative to the shaft 16, such that when the first, second, and third sets of teeth 18, 70, and 72 are engaged, and the shaft 16 is rotated, the block 20 can move between the extended position 52 and the retracted position 24. FIG. 4 shows the engagement links 66, 68 in the engaged position with the first, second, and third sets of teeth 18, 70, 72 engaged. In the disengaged position, the engagement links 66, 68 are simply moved back from the shaft 16 to allow sliding of the block 20 relative to the shaft 16.

Further provided in the drive mechanism 64 is an engagement link actuator 74 which is coupled to the first engagement link 66 and the second engagement link 68. Although one engagement link actuator 74 is shown in FIG. 4, any number of engagement link actuators may be used to control movement of the engagement links 66, 68. The engagement link actuator 74 is coupled to the first and second engagement links 66, 68 with a pivot link 76, to allow the first and second engagement links 66, 68 to be moved between an engaged position at which the second and third sets of teeth 70, 72 are engaged with the first set of teeth 18 (e.g., the block 20 can move when shaft 16 is rotated), and a disengaged position at which the second and third sets of teeth 70, 72 are disengaged with the first set of teeth 18 (e.g., the block 20 does not move from rotation of the shaft 16). In exemplary embodiments, the drive mechanism 64 may be configured such that the engagement links 66, 68 are passively engaged and actively disengaged, or passively disengaged and actively engaged. Additionally, when the engagement links 66, 68 are in the disengaged position, the block 20 is free to move parallel to the shaft in either direction when a force is applied the block 20.

Figure 5:
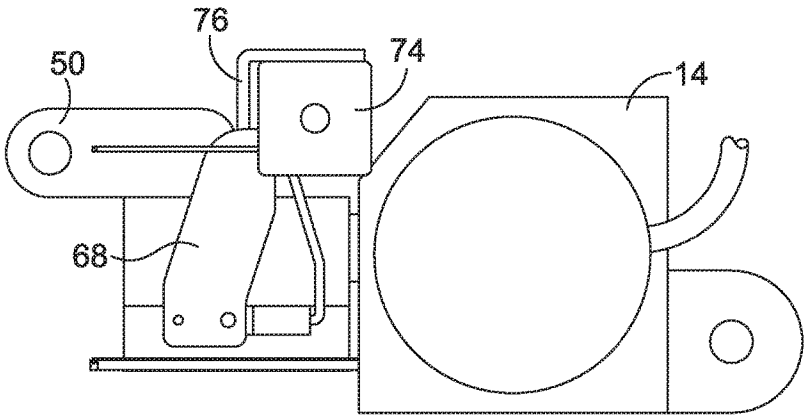
FIG. 5 is a partial, enlarged, side elevation view of the drive mechanism shown in FIG. 4, in accordance with an embodiment of the present technology.

Referring to FIG. 5, a partial, enlarged, side elevation view of the drive mechanism 64 shown in FIG. 4 is provided, in accordance with an embodiment of the present technology. In FIG. 5, depicted more clearly is the actuator 14, the second engagement link actuator 74, the pivot link 76, the second engagement link 68, and the bracket 50.

Figure 6A:
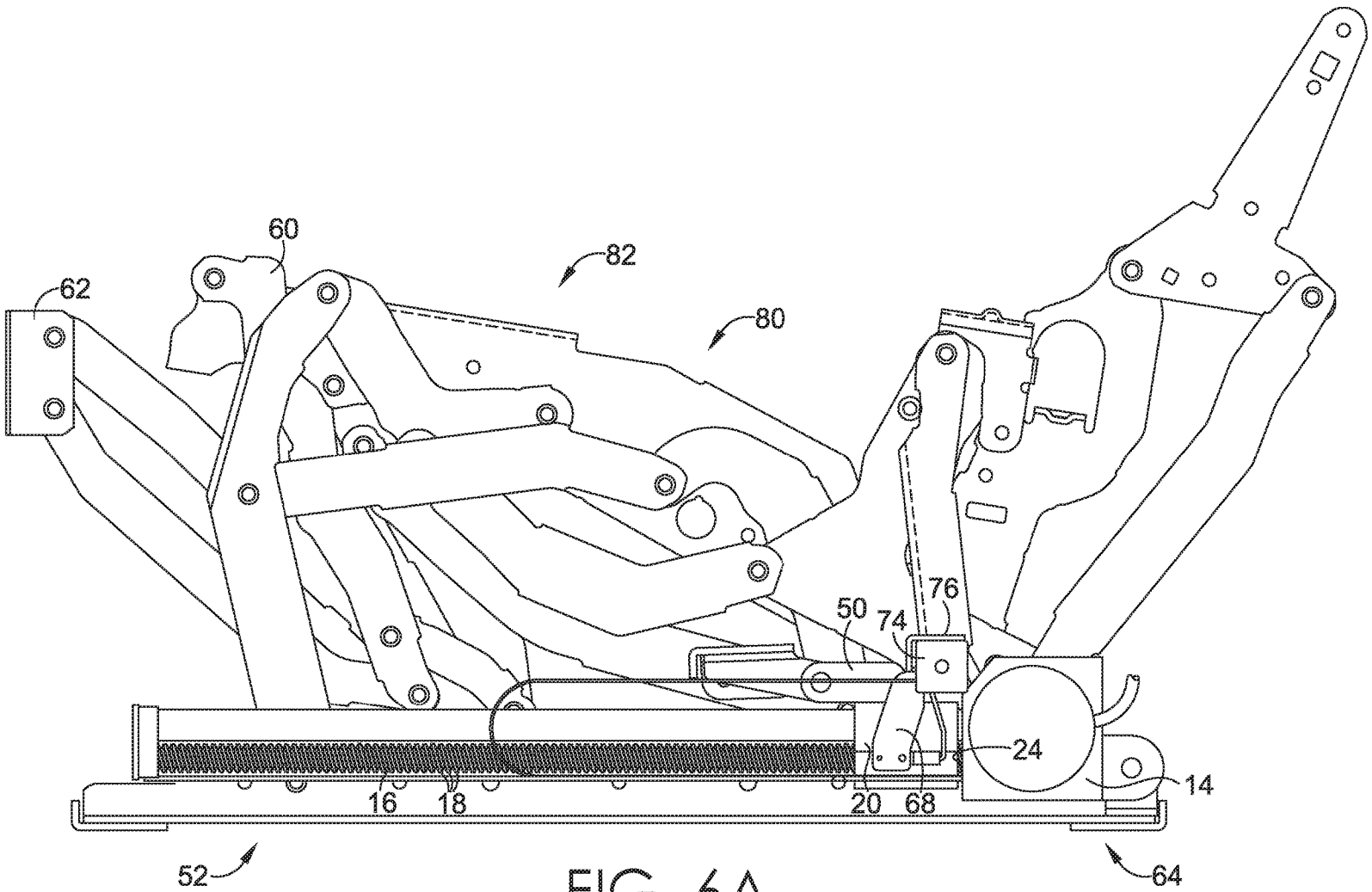
FIG. 6A is a side elevation view of a second exemplary quick-exit assembly for reclining furniture, in accordance with an embodiment of the present technology.
Figure 6B:
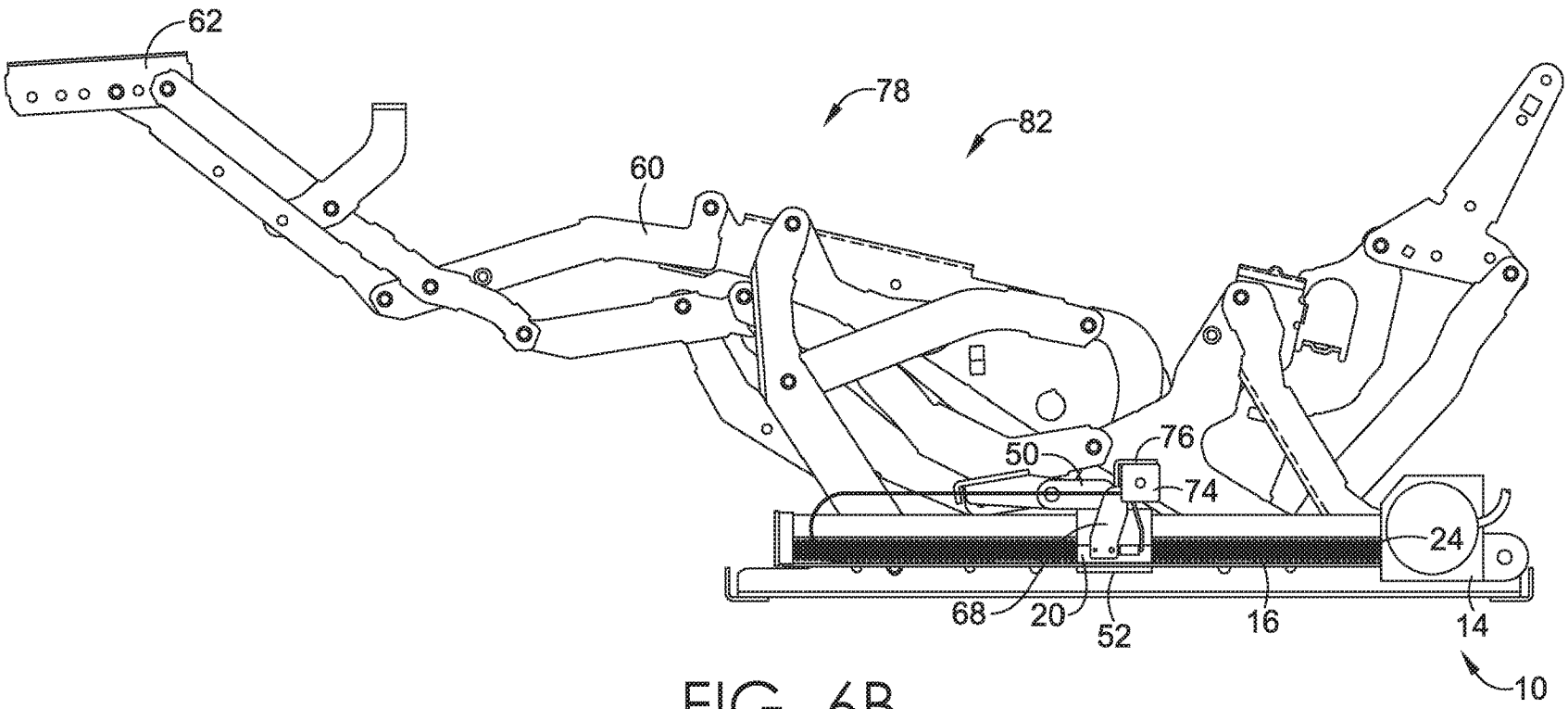
FIG. 6B is another side elevation view of the second exemplary quick-exit assembly shown in FIG. 6A in a more reclined position, in accordance with an embodiment of the present technology.

Referring to FIG. 6A, a side elevation view of a second exemplary quick-exit assembly 82 for reclining furniture is provided, in accordance with an embodiment of the present technology. The assembly 82 once again includes the linkage assembly 60, the ottoman portion 62, and the drive mechanism 64 from FIGS. 4-5. The drive mechanism 64 is coupled to the linkage assembly 60 with the bracket 50, such that movement of the block 20 between an extended position 52 and a retracted position 24 moves the linkage assembly 60 between a first position 78 (shown in FIG. 6B) and a second position 80 (shown in FIG. 6A). Referring to FIG. 6B, another side elevation view of the second exemplary quick-exit assembly 82 shown in FIG. 6A, with the linkage assembly 60 in the more reclined second position 78, is shown, in accordance with an embodiment of the present technology.

In an exemplary configuration and use of the quick-exit assembly 82, the linkage assembly 60 may be moved from the first position 78 to the second position 80 using the block 20, the shaft 16, and the engagement links 66, 68. For example, the engagement links 66, 68 may be passively disengaged (e.g., remain in a disengaged position until moved into the engaged position by the engagement link actuator 74). In the disengaged position, the second and third sets of teeth 70, 72 are not engaged with the first set of teeth 18, and as a result, the block 20 can slide freely on the shaft 16 between the retracted position 24 and the extended position 52 using manual force applied to the block 20 (e.g., a user leaning on the linkage assembly 60).

When movement of the block 20 under motorized power is desired, the engagement link actuator 74 may be activated, such as through use of a control device, to move the engagement links 66, 68 using the pivot link 76 to engage the first, second, and third sets of teeth 18, 70, 72. As a result, the block 20 is engaged with the shaft 16, and the actuator 14 can rotate the shaft 16 in either direction to move the block 20 between the retracted position 24 and the extended position 52.

In another exemplary configuration and use of the quick-exit assembly 82, the engagement links 66, 68 may be passively engaged (e.g., remain in an engaged position until moved into the disengaged position by the engagement link actuator 74), with the first, second, and third sets of teeth 18, 70, 72 engaged with each other. As a result, when the shaft 16 is rotated by the actuator 14, the block 20 can move between the retracted position 24 and the extended position 52, moving the linkage assembly 60 in a corresponding fashion. When manual movement is desired, the engagement link actuator 74 may be activated, such as through use of a control device communicatively coupled to the engagement link actuator 74, to move the engagement links 66, 68 to a disengaged position, allowing the block 20 to slide freely on the shaft 16. As a result, the linkage assembly 60 may be moved using manual force with reduced restriction from the drive mechanism 64.

Figure 7:
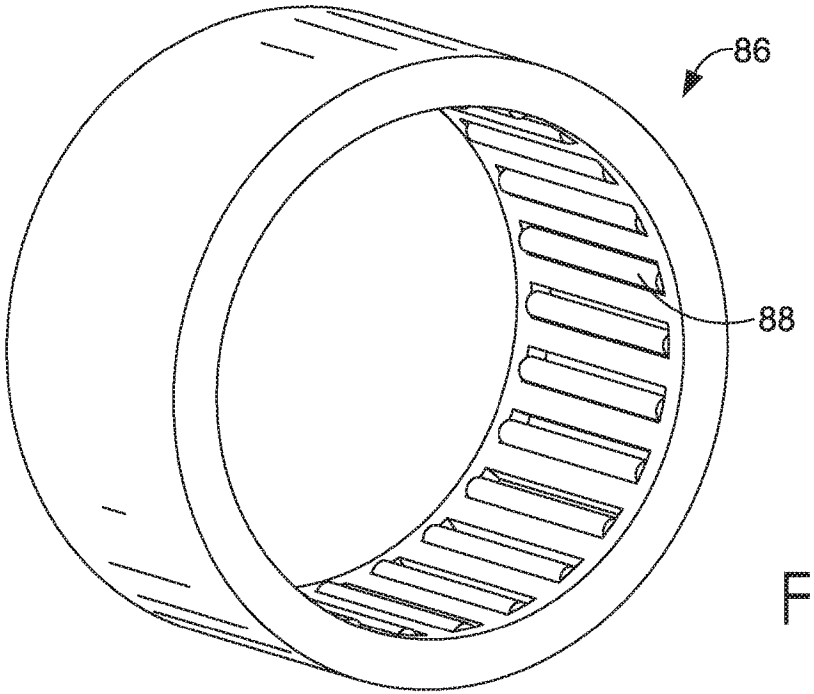
FIG. 7 is an exemplary one-way bearing for use in a drive mechanism of a quick-exit assembly for reclining furniture, in accordance with an embodiment of the present technology.

Referring to FIG. 7, an exemplary one-way bearing 86 for use in a drive mechanism of a quick-exit-assembly, such as the drive mechanism 10 shown in FIG. 1A, is provided, in accordance with an embodiment of the present technology. In FIG. 7, the exemplary one-way bearing 86 includes a plurality of one-way rollers 88 that are configured to turn in one direction, to allow rotation of the bearing 86 in one axial direction, and that are configured to reduce, restrict, or prevent rotation of the one-way bearing 86 in the other axial direction. In addition to one-way bearings, such as the one-way bearing 86 shown in FIG. 7, other one-way components may be used to provide rotation of the gears in one direction, and reduce, restrict, or prevent rotation of the gears in another direction. For example, a one-way clutch or other one-way-component may be used.

From the foregoing, it will be seen that this invention is one well adapted to attain all the ends and objects hereinabove set forth together with other advantages, which are obvious and which are inherent to the structure. It will be understood that certain features and subcombinations are of utility and may be employed without reference to other features and subcombinations. This is contemplated by and is within the scope of the claims.

The invention claimed is:

1. A quick-exit assembly for reclining furniture, comprising:

a linkage assembly; and a drive mechanism comprising at least one actuator, the drive mechanism coupled to the linkage assembly and configured to:

move the linkage assembly from a first position to a second position using the at least one actuator, and allow movement of the linkage assembly from the first position to the second position manually with reduced restriction from the drive mechanism, wherein the drive mechanism comprises a worm drive having a shaft and a block, wherein the shaft is coupled to the at least one actuator, and wherein the block is coupled to the shaft and to the linkage assembly.

2. The assembly of claim 1, wherein the linkage assembly comprises a plurality of rotatably coupled linkages.

3. The assembly of claim 2, wherein the first position is a reclined position and the second position is an upright position relative to the reclined position.

4. The assembly of claim 1, wherein the block is adjustable from an extended position at which the linkage assembly is in the first position and a retracted position at which the linkage assembly is in the second position using:

rotation of the shaft using the at least one actuator; or a force applied to the block.

5. A quick-exit assembly for reclining furniture, comprising:

a linkage assembly; and a drive mechanism coupled to the linkage assembly, the drive mechanism comprising:

at least one actuator, a shaft having a first set of teeth, the shaft rotatably coupled to the at least one actuator, a block coupled to the shaft and to the linkage assembly, the block comprising a first gear having a second set of teeth that engage with the first set of teeth, and a first one-way bearing that couples the first gear to the block.

6. The assembly of claim 5, further comprising a second gear rotatably coupled to the block with a second one-way bearing, the second gear comprising a third set of teeth that engage with the first set of teeth.

7. The assembly of claim 6, wherein the block is configured to move from an extended position to a retracted position through:

rotation of the shaft by the at least one actuator; or rolling of the first gear and the second gear across the shaft, wherein the extended position corresponds to a first position of the linkage assembly and the retracted position corresponds to a second position of the linkage assembly.

8. The assembly of claim 7, wherein rotation of the shaft by the at least one actuator in a first direction provides, from the first set of teeth, a force against the second set of teeth and the third set of teeth that moves the block from the extended position to the retracted position.

9. The assembly of claim 8, wherein the first and second one-way bearings restrict movement of the first and second gears in response to the force provided against the second and third sets of teeth by the first set of teeth.

10. The assembly of claim 9, wherein the at least one actuator is configured to reverse direction.

11. A quick-exit assembly for reclining furniture, comprising:

a linkage assembly; and a drive mechanism comprising:

an actuator, a shaft rotatably coupled to the actuator, the shaft comprising a first set of teeth, a block coupled to the linkage assembly, a first engagement link movably coupled to the block and comprising a second set of teeth configured to engage with the first set of teeth, and a second engagement link movably coupled to the block, the second engagement link comprising a third set of teeth configured to engage with the first set of teeth.

12. The assembly of claim 11, wherein the linkage assembly comprises a plurality of rotatably coupled linkages configured to move between a first position and a second position.

13. The assembly of claim 11, wherein the block is movable relative to the shaft when the first engagement link and the second engagement link are in an engaged position and the shaft is rotated.

14. The assembly of claim 13, wherein the first engagement link and the second engagement link are coupled to at least one engagement actuator.

15. The assembly of claim 14, wherein the at least one engagement actuator is configured to at least one of:

move the first engagement link and the second engagement link from a disengaged position to the engaged position; and move the first engagement link and the second engagement link from the engaged position to the disengaged position.

16. The assembly of claim 15, further comprising a control device communicatively coupled to the at least one engagement actuator and configured to control movement of the first and second engagement links using the engagement actuator.

17. The assembly of claim 16, further comprising at least one pivot link that rotatably couples the first engagement link and the second engagement link to the at least one engagement actuator.

18. The assembly of claim 11, wherein the actuator is reversible.

* * * * *